United States Patent [19]

Viré et al.

[11] Patent Number: 4,552,637

[45] Date of Patent: Nov. 12, 1985

[54] CELL FOR THE REFINING OF ALUMINIUM

[75] Inventors: Sylvestre Viré, Neuhausen am Rheinfall; Ludwig Gauckler, Schaffhausen, both of Switzerland

[73] Assignee: Swiss Aluminium Ltd., Chippis, Switzerland

[21] Appl. No.: 586,283

[22] Filed: Mar. 5, 1984

[30] Foreign Application Priority Data

Mar. 11, 1983 [CH] Switzerland ..... 1343/83

[51] Int. Cl.[4] ..... C25C 3/08; C25C 7/04

[52] U.S. Cl. ..... 204/243 R; 204/295

[58] Field of Search ..... 204/67, 243 R–247, 204/295

[56] References Cited

U.S. PATENT DOCUMENTS

| | | | |
|---|---|---|---|
| 3,386,908 | 6/1968 | Daurat | 204/245 X |
| 4,118,292 | 10/1978 | Fray et al. | 204/67 |
| 4,338,177 | 7/1982 | Withers et al. | 204/245 X |
| 4,405,415 | 9/1983 | Dewing et al. | 204/243 R X |
| 4,411,747 | 10/1983 | Dawless et al. | 204/67 |
| 4,430,174 | 2/1984 | Tsumura | 204/67 |

FOREIGN PATENT DOCUMENTS

| | | | |
|---|---|---|---|
| 9145982 | 6/1983 | Australia | 204/243 R |

*Primary Examiner*—Donald R. Valentine

*Attorney, Agent, or Firm*—Bachman & LaPointe

[57] ABSTRACT

An exchangeable separator is horizontally located within a three-layer refining cell for the electrolytic purification of aluminum. This separator is freely movable in the vertical direction within a movement space (h) defined by a refractory frame. The porosity of the separator is at least 30%, preferably at least 50%, so that the electrolyte and metal can pass through the separator without any significant additional loss of potential.

In industrial refining cells, the separator appropriately has a thickness of 0.5 to 2 cm and a disc-shaped design, the vertical movement space (h) being 0.5 to 1 cm. The level changes produced during the operation of the cell can be compensated for in this free movement space.

13 Claims, 3 Drawing Figures

CELL FOR THE REFINING OF ALUMINIUM

BACKGROUND OF THE INVENTION

The present relates to a cell for the electrolytic purification of aluminum, comprising a trough having an outer steel tank, a refractory lining and a carbon base containing the anodically connected iron bars; a melt of an aluminum alloy doped with a heavy metal or heavy metals, which has a density $\rho_1$ and forms the anode; a layer of molten electrolyte material resting on the anode and having a density $\rho_2$; a top layer of molten extra-high purity aluminum, which has a density $\rho_3$ and forms the cathode; and graphite cathodes which are fixed to the cathode cell structure and dip from above into the extra-high purity aluminum; $\rho_1$ being greater than $\rho_2$ which is greater than $\Sigma_3$.

The electrolytic refining of aluminum, like all electrolytic refining processes, is based on the fact that the, relative to aluminum, comparatively

- base components (for example, sodium, lithium and calcium) of the alloy employed, while dissolving anodically in the aluminum, cannot be deposited at the cathode, and
- the noble components (for example, copper, silicon, iron and titanium) do not dissolve anodically and thus stay behind in the anode metal, with formation of liquation crystals.

The three-layer refining cells for aluminum, which have been known since the beginning of this century, contain three liquid layers:

- the heavy bottom layer which consists customarily of an Al/Cu/Si/Fe alloy and whose surface is at the same time the anode;
- the electrolyte layer consisting of the fluorides and/or chlorides of alkali metals and alkaline earth metals; and
- the refined aluminum, the third (top) layer whose lower surface forms the cathode.

When the electrolysis direct current is applied, the aluminum is oxidized at the anode to trivalent aluminum ions; these ions migrate to the cathode where they are reduced back to aluminum.

Through the forehearth of the cell, which is at a lower temperature than the 750° C. that is customary for the refining of aluminum, the impurities that have crystallized out, particularly intermetallic products of Al, Cu, Fe and Si, known as liquation crystals, are removed.

The energy consumption of the three-layer refining cell for aluminum is relatively high. Typical values for the cell voltage are about 5.5 V, for a current efficiency of about 95 to 97%. This gives an energy consumption of approximately 17 to 18 kWh/kg of refined aluminum. From a purely physical point of view, the energy consumption of the aluminum-refining electrolysis can be reduced essentially by two measures:

- electrolytes having a higher electric conductivity are employed and/or
- the interpolar distance, that is the thickness of the electrolyte layer, is lowered.

The electrolyte layer, which customarily has a thickness of 10 to 20 cm, cannot, however, be reduced indefinitely without the risk of mechanical contamination of the refined aluminum layer through contact with the anodically connected aluminum alloy.

U.S. Patent Specification Nos. 4,115,215 (Re 30,330) and 4,214,956 propose an apparatus for the electrolytic refining of aluminum which deviates from the three-layer method that has been customary so far. The aluminum alloy to be purified is placed in a vessel-shaped diaphragm which is surrounded by a molten electrolyte. The density $\rho_2$ of this electrolyte, in contrast to the three-layer refining cell, lies below that ($\rho_3$) of the extra-high purity aluminum. By using a diaphragm that is impermeable to the aluminum alloy to be refined, the problem of mechanical contamination can be solved. The diaphragm material used is "Poros Carbon PC-25" from UNION CARBIDE Corporation, having a porosity of 48% and a mean pore diameter of 0.12 mm.

The requirements for the diaphragm according to the two U.S. Patent Specifications may be characterized as follows: on the one hand, the diaphragm of an aluminum refining cell has to be impermeable to the aluminum alloy employed and, on the other hand, it is to have the lowest possible electric resistance. Obviously, these two requirements are mutually opposed with respect to the thickness and porosity of the diaphragm. Thus the properties of the diaphragm are of critical importance for the specific energy consumption of the refining cell.

Not only do the higher-melting Al/Si/Fe compounds formed during the electrolytic refining of aluminum alloys reduce the efficiency, that is to say the ratio of the aluminum recovered to that employed, but the liquation of such alloys can lead to the clogging of the finely porous diaphragm. At any rate, by using such a refining cell with diaphragm, the specific energy consumption can be taken to values somewhat below those attained in the electrolytic production of aluminum by means of modern Hall/Héroult cells.

The inventors have set themselves the object of providing a cell for the electrolytic purification of aluminum having a low diffusion resistance and low electric resistance, by means of which cell high metallurgical efficiency is achieved. A three-layer refining cell is to be employed which, due to the low electric resistance intended, is provided with better thermal insulation.

SUMMARY OF THE INVENTION

According to the invention, the foregoing object is achieved by means of an exchangeable separator, horizontally located at least partially within or directly outside the electrolyte later and consisting of a material resistant to the electrolyte and to metal, which separator is freely movable in the vertical direction within a space defined by a corrosion-resistant and refractory frame while its porosity of at least 30% allows the electrolyte and metal to pass through without any significant additional loss of potential.

In this connection, a separator is taken to mean a separating layer having an open pore structure and developing only a geometric, but not an electrolytic, effect. By contrast, the much more finely porous diaphragms, which are not employed here, also have an electrolytic effect.

By employing a separator which possesses preferably a porosity of at least 50%, particularly 90 to 97%, and has a pore size of between 0.5 and 2 mm, the three-layer cell can be operated with a considerably thinner electrolyte layer, without the risk of clogging or of a significant additional loss of voltage. A separator is able to avoid the mechanical contamination of the refined aluminum by the anodic alloy, without having to be wettable by any metal. In that case, however, the electrolyte has to penetrate thoroughly into the separator material;

otherwise additional losses of voltage could not be avoided.

According to the present invention, it is of great importance that the separator transmits virtually no mechanical stress. Since the separator is vertically adjustable within the defined space, the weight of the aluminum above the separator is immaterial.

The interpolar distance, being shortened as a result of a thinner electrolyte layer, results in a reduced electric resistance, by comparison with customary three-layer refining cells, if the specific electric resistance of the electrolyte remains approximately constant. Therefore, less heat is generated in the electrolytic refining process. In order to maintain the thermal equilibrium, that is to say a constant operating temperature, the cell is better insulated.

Instead of, or in addition to, improving insulation, however, it is also possible to increase the current density, which results in increased generation of heat.

The horizontally located exchangeable separator has preferably a disc-shaped design and preferably a thickness of 0.5 to 2 cm. In industrial refining cells, these separator layers can expediently be moved by 0.5 to 1 cm in the vertical direction. In practice, this free space is enough to compensate for the change in level of the layers, produced when ladling out from the forehearth the impurities that have crystallized out and/or when adding anode metal. Level changes of this kind can adversely affect fixed separators, especially if thin discs are employed.

The use of the separators according to the invention enables the thickness of the electrolyte layer, customarily of 10 to 20 cm, to be lowered to a thickness of 1.5 to 5 cm (excluding the separator). As a result, the voltage drop across the interpolar distance can be decreased from between 5 and 6 V to between 1 and 2 V.

Appropriately, the thickness of the electrolyte layer and the thickness of the separator or of the separator disc(s) are related so that the thickness of the separator layer amounts to between 30 and 40% of the thickness of the electrolyte layer.

Separator materials that are employed as being more easily wettable by the ellectrolyte than by the molten metal are aluminum oxide, aluminum nitride, aluminum oxynitride, magnesium oxide, magnesium oxide/calcium oxide, silicon nitride, silicon aluminum oxynitride and/or at least one spinel. When these materials are employed, care has to be taken that the separator can be moved in the vertical direction only within the electrolyte layer. More favorable material costs more than compensate for the smaller free level range.

On the other hand, separator materials that can be employed as being wettable also by the molten metal are, for example, titanium diboride, titanium carbide, titanium nitride, zirconium diboride, zirconium carbide and/or zirconium nitride. Separators made from these materials can be situated completely within the electrolyte layer, partly in the electrolyte layer and partly in a metal layer, or completely in the lower metal layer. In the latter case, however, the layer thickness of the liquid aluminum alloy above the separator has to be relatively small, that is to say at most a few millimeters. In this case, the greater mobility of the separator layer in the vertical direction is obtained at the price of higher material costs. If desired, the costs may be lowered in this case by coating the separator only with material that is wettable by the metal and by the electrolyte.

Apart from the wettability of the separator material, its electric conductivity also plays a part. Electrically insulating separator material cannot act as a bipolar electrode; conduction of the electrolysis direct current takes place within the electrolyte layer exclusively by migration. As a rule, electrically insulating separator material is not wettable by the metal and is therefore placed completely within the electrolyte layer. By way of contrast, electrically conducting separators act as bipolar electrodes; therefore the voltage drop above the separator must not be greater than the decomposition voltage of aluminum.

An advantageous further development of the three-layer refining cell is for the upper part of the internal walls, at least within the zone of the electrolyte layer, to consist of a material that is more easily wettable by aluminum than by the electrolyte. In this way, the formation of incrustation, caused by movements within the electrolyte layer, can be prevented. A suitable lining material of this kind, in particular, is Refrax from the CARBORUNDUM Company (Refrax is a trademark of the Carborundum Company).

BRIEF DESCRIPTION OF THE DRAWINGS

The invention will be explained in detail with reference to the drawing. In diagrammatic fashion.

DETAILED DESCRIPTION

Figure 1:
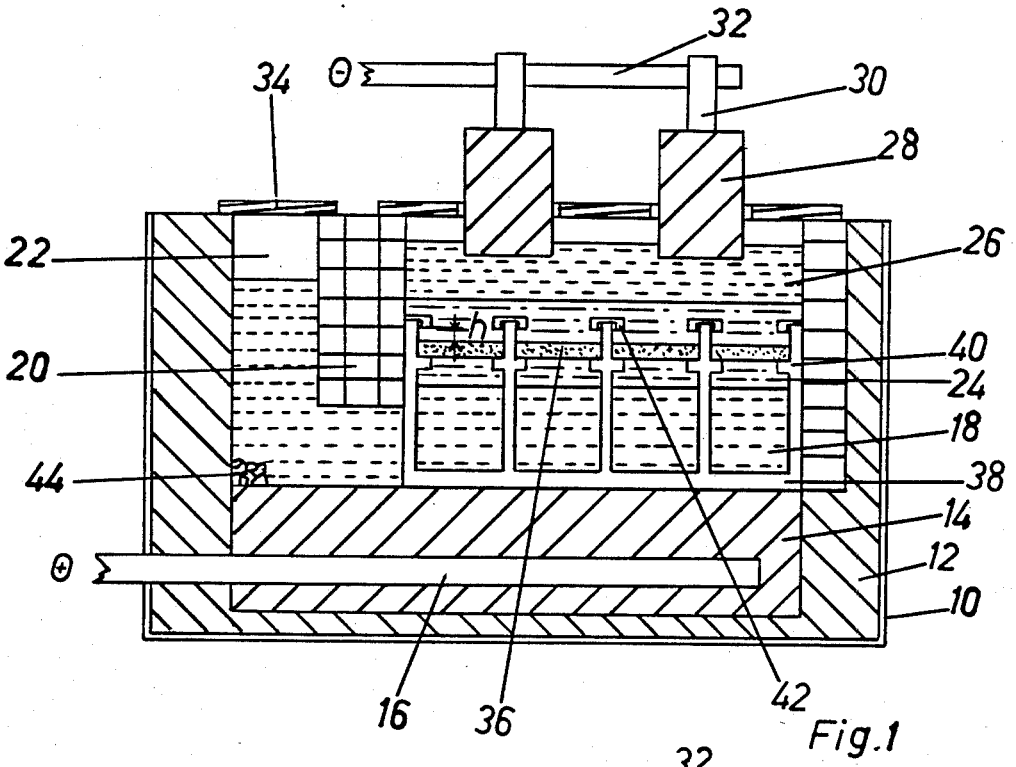
FIG. 1 shows a vertical section through a three-layer refining cell with a separator in the electrolyte layer.

The trough of a three-layer refining cell is formed by an outer steel tank 10, coated with a refractory lining 12 as a thermal insulation layer; into this lining is incorporated the carbon base 14, a solid layer which contains the iron bars 16 that conduct the anodic current.

The lower part of the vessel formed contains the molten aluminum alloy 18 (which may also be described as impure aluminum), having the relatively high density $\rho_1 = 3.1$ to $3.2$ g/cm$^3$. This high density is obtained, for example, by alloying approximately 30% by weight of copper. In accordance with the rule for communicating vessels, the molten aluminum alloy 18 extends into forehearth 22 which is separated by magnesite bricks 20.

The reaction chamber of the three-layer refining cell contains the electrolyte layer 24, having a density $\rho_2 = 2.5$ to $2.6$ g/cm$^3$. The molten electrolyte consists of known salt mixtures of alkali metal halides and alkaline earth metal halides, such as, for example, 44% by weight of $AlF_3$, 30% by weight of $BaF_2$, 15% by weight of NaF and 11% by weight of $MgF_2$.

Finally, the liquid extra-high purity aluminum 26 forms the top layer. It has a density $\rho_3 \simeq 2.3$ g/cm$^3$. Solid graphite cathodes 28 which are fastened to the cathodic cell structure 32 by way of support-rods 30 dip into this liquid extra-high purity aluminum.

For improved thermal insulation, the three-layer refining cells are covered with lids 34, made of a known heat-resistant insulating material.

The separator 36 in FIG. 1, having a disc-shaped design, is located completely within the electrolyte layer 24 in a horizontal position. It is carried by a frame 38, which is resistant to the molten metal and the electrolyte, by means of lower support-lugs 40. The frame, consisting, for example, of Refrax or $Al_2O_3$, can be withdrawn bodily from the cell. The separator 36 can also be exchanged by lifting off the upper dogs 42.

If fresh metal to be purified is added through the forehearth 22, the separator 36 is lifted at most up to the upper dogs 42 and then goes down gradually back to the lower support-lugs 40. The vertical movement space h of the separator is 0.5 cm. The liquation crystals 44 accumulate below the forehearth 22 and can be easily removed through the latter. The liquation crystals formed are generally rich in iron.

Figure 2:
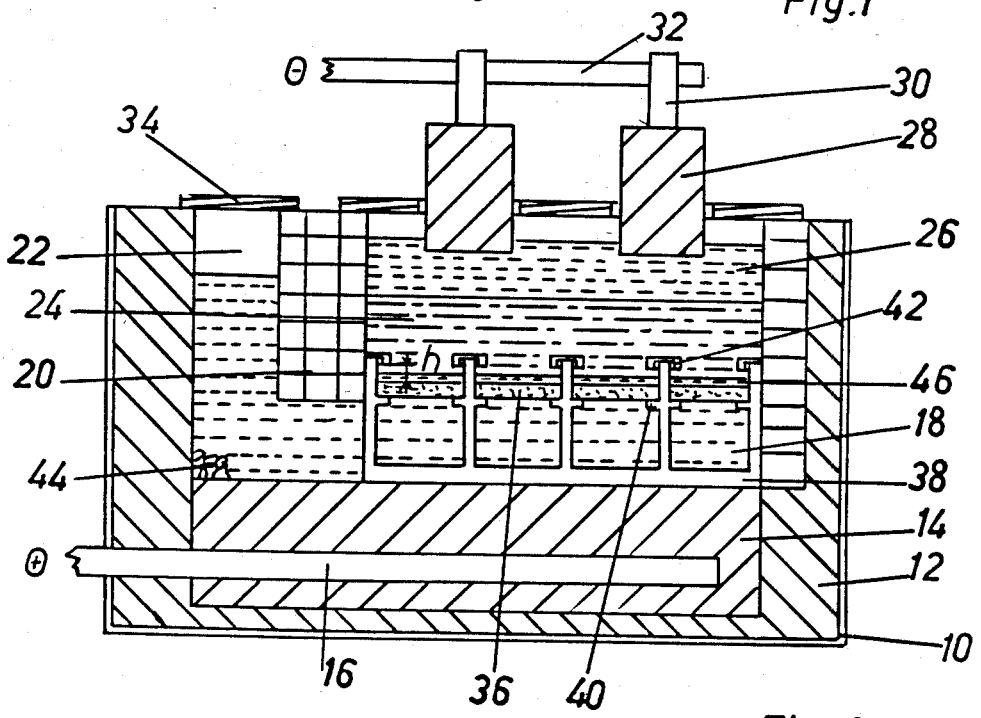
FIG. 2 shows a vertical section through a three-layer refining cell with a separator just below the electrolyte layer.

The separator 36 in FIG. 2 consists of titanium diboride which is wettable both by the electrolyte and by the molten metal. The lower support-lugs 40 of the frame 38 are arranged so that the separator 36, in its lowest position, is placed exclusively in the molten aluminum alloy 18. The layer 46 of liquid alloy, situated above the separator, however, has a thickness of less than 5 mm. The movement space h of the separator in the vertical direction is larger than in FIG. 1; it is about 1 cm.

Figure 3:
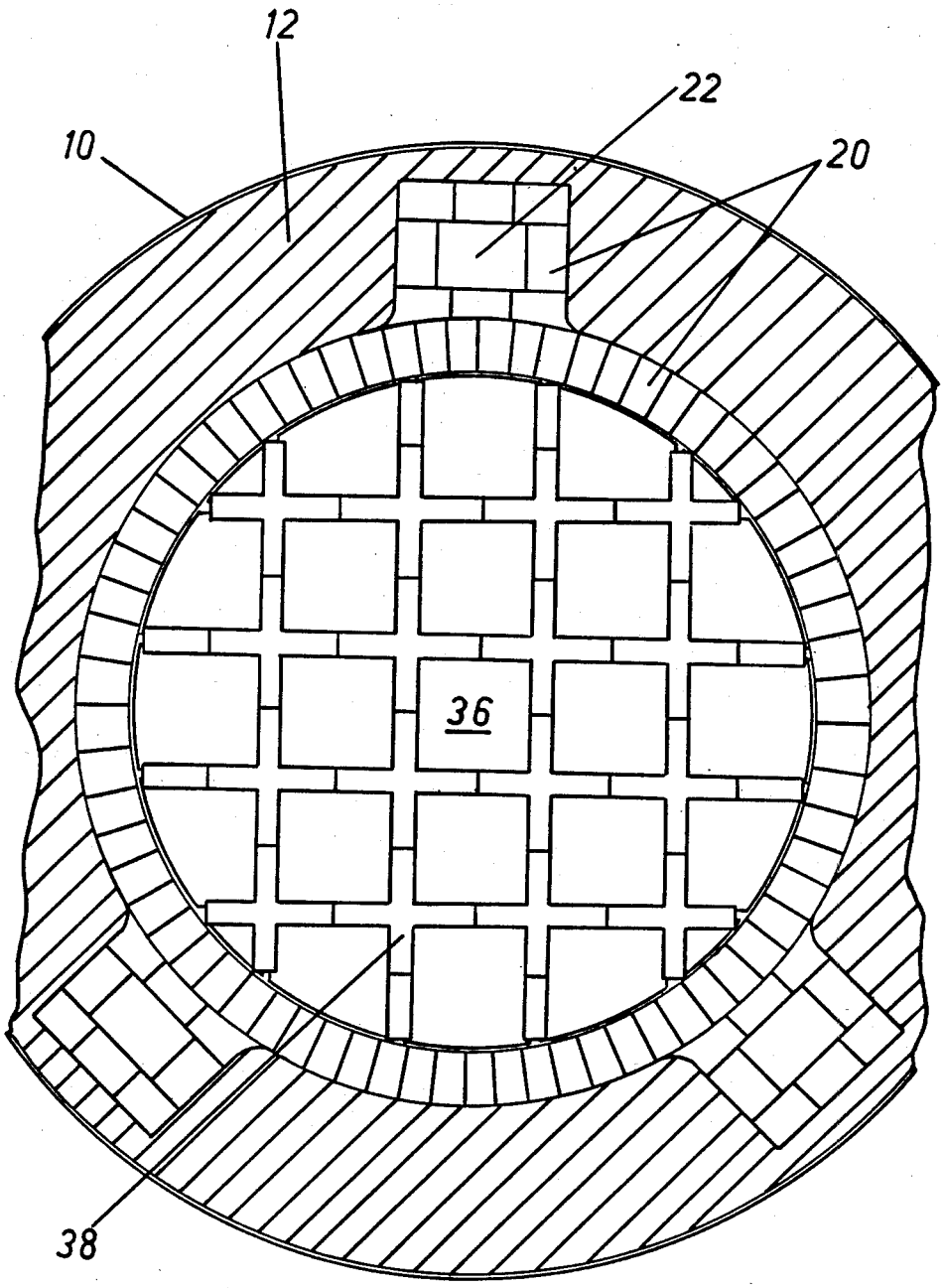
FIG. 3 shows a horizontal section through a three-layer refining cell with three forehearths.

FIG. 3 shows a three-layer refining cell with three forehearths 22 which—again within the space of the cell lining—are covered with magnesite bricks 20. The jacket of the trough is also lined with magnesite bricks 20. The pull-out frame 38 for the plate-shaped separators 36 has a square grid.

EXAMPLE 1

A molten aluminum/copper/silicon/iron alloy is refined by means of a cell of the type according to FIG. 1. The disc-shaped separator, made of sintered porous (90%) aluminum oxide, has a thickness of 2 cm and can freely move in the predetermined movement space within the electrolyte layer, which layer has a thickness of 3.5 cm, exclusive of the separator. The separator has a pore size of 0.5 mm. With this arrangement, a potential difference of 2.0 V is measured, which represents an energy consumption of about 6 kWh/kg of refined aluminum.

EXAMPLE 2

A disc-shaped separator, made of MgO and having a thickness of 1 cm and a porosity of 95%, is inserted into a cell of the type of FIG. 1. The pore size is 0.5 mm. The electrolyte layer in which the free vertical movement space of the separator lies has a thickness of 2.5 cm, exclusive of the latter. This results in a potential difference of 1.5 V, which leads to an energy consumption of about 4.7 kWh/kg of aluminum.

EXAMPLE 3

A separator, made of porous $TiB_2$(90% porosity) and wettable by liquid metal and electrolyte, is arranged in a cell of the type of FIG. 2. The separator which has a thickness of 0.5 cm is located completely in the liquid aluminum alloy according to Example 1, 3 mm below the electrolyte layer. The pore size of the separator is again 0.5 mm. Since the electrolyte layer has a thickness of only 1.5 cm, a potential difference of only 1.0 V is measured. The energy consumption of only about 3 kWh/kg of aluminum may be described as very low.

Extra-high purity aluminum is produced in all three examples, having a purity of more than 99.995% by weight.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A thermally insulated cell for the electrolytic purification of aluminum, comprising a trough having an outer steel tank, a refractory lining and a carbon base containing anodically connected iron bars; a melt of an aluminum alloy doped with at least one heavy metal and having a density $\rho_1$ forms the anode; a layer of molten electrolyte material resting on the anode and having a density $\rho_2$; a top layer of molten extra-high purity aluminum and having a density $\rho_3$ forms the cathode; and graphite cathodes which are fixed to the cathode cell structure and dip from above into the extra-high purity aluminum wherein $\rho_1$ is greater than $\rho_2$ which is greater than $\rho_3$, the improvement which comprises an exchangeable separator horizontally located at least partially within said cell and consisting of a porous material resistant to the electrolyte and to metal, said separator being freely movable in the vertical direction a distance (h) defined by a corrosion-resistant, refractory frame wherein the porosity of the separator allows the electrolyte and metal to pass through without any significant additional loss of potential.

2. A cell according to claim 1 wherein the separator has a porosity of at least 30%.

3. A cell according to claim 1 wherein the separator has a thickness of between 0.5 to 2 cm and the electrolyte layer a thickness of 1.5 to 5 cm.

4. A cell according to claim 1 wherein the thickness of the separator is between 30 to 40% the thickness of the electrolyte layer.

5. A cell according to claim 1 wherein the distance (h) is between 0.5 to 1 cm.

6. A cell according to claim 1 wherein the separator has a porosity of at least 50% and the pore size is between 0.5 and 2 mm.

7. A cell according to claim 1 wherein the separator has a porosity of between 90 to 97%.

8. A cell according to claim 1 wherein the separator consists of a material which is more easily wettable by the electrolyte than by the molten metal such that the separator can move in the vertical direction only within the electrolyte layer.

9. A cell according to claim 7 wherein the separator consists of a material selected from the group consisting of aluminum oxide, aluminum nitride, aluminum oxynitride, magnesium oxide, magnesium oxide/calcium oxide, silicon nitride, silicon aluminum oxynitride and/or of at least one spinel.

10. A cell according to claim 1 wherein the separator consists of a material that is wettable by the electrolyte and the molten metal.

11. A cell according to claim 10 wherein at least the surface of the separator consists of a material selected from the group consisting of titanium diboride, titanium carbide, titanium nitride, zirconium diboride, zirconium carbide and/or zirconium nitride.

12. A cell according to claim 1 wherein the inside of the trough is lined in the upper zone with a material that is more easily wettable by aluminum than by the electrolyte.

13. A cell according to claim 12 wherein said material is Refrax.

* * * * *